US007766248B2

(12) United States Patent
Webster et al.

(10) Patent No.: US 7,766,248 B2
(45) **Date of Patent: *Aug. 3, 2010**

(54) MODEL TOY TRAIN TRACK

(75) Inventors: Richard Webster, New Baltimore, MI (US); Bradley Salminen, Sterling Heights, MI (US); Morgan Wireman, Berkley, MI (US)

(73) Assignee: Lionel L.L.C., Chesterfield, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/946,789

(22) Filed: Nov. 28, 2007

(65) Prior Publication Data

US 2008/0067261 A1 Mar. 20, 2008

Related U.S. Application Data

(63) Continuation of application No. 10/937,006, filed on Sep. 9, 2004, now Pat. No. 7,320,435, which is a continuation-in-part of application No. 10/342,511, filed on Jan. 15, 2003, now Pat. No. 6,796,509.

(51) Int. Cl.
*E01B 23/00* (2006.01)

(52) U.S. Cl. ..... 238/10 E

(58) Field of Classification Search ..... 238/2, 238/10 R, 10 A, 10 B, 10 C, 10 E, 10 F, 14.05, 238/14.3

See application file for complete search history.

(56) References Cited

U.S. PATENT DOCUMENTS

| | | | | |
|---|---|---|---|---|
| 1,467,475 | A | 9/1923 | Egolf | |
| 2,012,514 | A | 11/1935 | Martin | |
| 2,021,514 | A * | 11/1935 | Martin | 238/10 R |
| 2,265,965 | A | 12/1941 | Frisbie | |
| 2,673,689 | A | 3/1954 | Bonanno | |
| 2,871,308 | A | 1/1959 | Pettit | |
| 3,074,647 | A | 1/1963 | Bonanno | |
| 4,116,381 | A | 9/1978 | Tong | |
| 4,231,517 | A | 11/1980 | Cheng | |
| 4,709,856 | A | 12/1987 | Rother et al. | |
| 4,953,785 | A | 9/1990 | Keska | |
| 5,299,735 | A | 4/1994 | Thomas | |

(Continued)

OTHER PUBLICATIONS

"The All New Lionel Trutrack System", Lionel Brochure, undated.

(Continued)

*Primary Examiner*—S. Joseph Morano
*Assistant Examiner*—Robert J McCarry, Jr.
(74) *Attorney, Agent, or Firm*—O'Melveny & Myers LLP

(57) ABSTRACT

A model toy train track segment in accordance with the present invention comprises an elongate roadbed having a first and a second end and a first and a second side. The said first and second ends of the track segment are configured for attachment to adjacent track segments. A track segment in accordance with the present invention further includes a side member configured to be detachably coupled to at least one of the first and second sides of the roadbed. A track segment in accordance with the present invention still further includes a first and a second elongate rail segment connected to the roadbed. Each of the first and second rail segments having a first end proximate to the first roadbed end and a second end proximate to the second roadbed end.

20 Claims, 8 Drawing Sheets

U.S. PATENT DOCUMENTS

| | | | | |
|---|---|---|---|---|
| 5,503,330 | A | 4/1996 | Riley | |
| 5,690,278 | A | 11/1997 | Grubb | |
| 5,967,052 | A | 10/1999 | Prokopf | |
| D421,281 | S | 2/2000 | Riley | |
| 6,019,289 | A | 2/2000 | Sung | |
| 6,398,120 | B1 * | 6/2002 | Klein | 238/10 B |
| 6,796,509 | B1 * | 9/2004 | Webster et al. | 238/10 E |

OTHER PUBLICATIONS

"With a 'Click' into the New Millennium. C Track", Marklin HO Brochure, 1996E, Gebr. Marklin & Cie. GMBH, Goppingen, Germany, May 1, 1996.

MTH Electric Trains 2001, vol. III, 2001, pp. 130, 131, 137.

* cited by examiner

MODEL TOY TRAIN TRACK

CROSS REFERENCE TO RELATED APPLICATIONS

This patent application is a continuation of U.S. patent application Ser. No. 10/937,006, filed Sep. 9, 2004 now U.S. Pat. No. 7,320,435, which is a continuation-in-part of U.S. patent application Ser. No. 10/342,511, filed Jan. 15, 2003, issued as U.S. Pat. No. 6,796,509 on Sep. 28, 2004.

BACKGROUND OF THE INVENTION

1. Field of Invention

This invention relates to a model toy train systems. More particularly, this invention relates to model toy railroad tracks.

2. Discussion of Related Art

Model toy railroads, and model toy railroad tracks in particular, have been generally known for decades. In a typical model toy railroad layout, a model train having an engine is provided. The model train engine includes an electrical motor that receives power from a voltage that is applied to the tracks. A transformer is used to apply the power to the tracks, while contacts (e.g., roller) on the bottom of the train, or metallic wheels of the train, pick up the applied power for the train motor. In a so-called conventional control model toy train layout, the transformer controls the amplitude, and in a DC system, the polarity, of the voltage, thereby controlling the speed and direction of the train. In HO systems, the voltage is a DC voltage. In O-gauge systems, the track voltage is an AC voltage transformed by the transformer from 60 Hz, 120 volt AC line voltage provided by a standard wall socket, to a reduced AC voltage (e.g., 0-18 volts AC).

Over the course of time, model toy railroad layouts have developed to include various railroad accessories to provide improved user control, increased features, and heightened levels of realism, which have converged to improve, generally, user satisfaction. One such area of development has been in the train track segments that make up the railroad layout. Some so-called conventional model toy train track segments include roadbeds, while others do not. Track segments having roadbeds have increased the level of realism of the overall railroad layout in that the track segments mimic actual railroad tracks wherein the rails of the tracks are mounted on a roadbed, and in some instances, are elevated in relation to the area surrounding the track. Similarly, the roadbed in model train systems allows for the addition of cosmetic features, such as, for example, railroad ties that can be molded into the roadbed or otherwise affixed thereto.

Conventional model track segments having roadbeds are not without their disadvantages, however. For example, track segments having roadbeds can be measurably wider and bulkier than track segments that do not have roadbeds. Accordingly, the adaptability, versatility and use of the track segments having roadbeds may be limited by the available space in a layout and/or surrounding area. Further, the increased material and production costs associated with conventional track segments having roadbeds can present an increased cost to model railroad enthusiasts. Additionally, in some conventional track segments having a roadbed, the durability of the connectors used to connect adjacent track segments together can be less than desirable.

Accordingly, a need exists for a model toy train track that minimizes and/or eliminates one or more of the above identified deficiencies.

SUMMARY OF THE INVENTION

A model toy train track segment is presented. A model toy train track segment in accordance with the present invention comprises an elongate roadbed having first and second ends, and first and second sides. The first and second ends of the track segment are configured for attachment to adjacent track segments. A track segment in accordance with the present invention further includes a side member configured to be detachably coupled to at least one of the first and second sides of the roadbed. A track segment in accordance with the present invention still further includes a first and a second elongate rail segment connected to the roadbed, wherein each of the first and second rail segments have a first end proximate to the first end of the roadbed and a second end proximate to the second end of the roadbed.

DETAILED DESCRIPTION OF INVENTION

Figure 1:
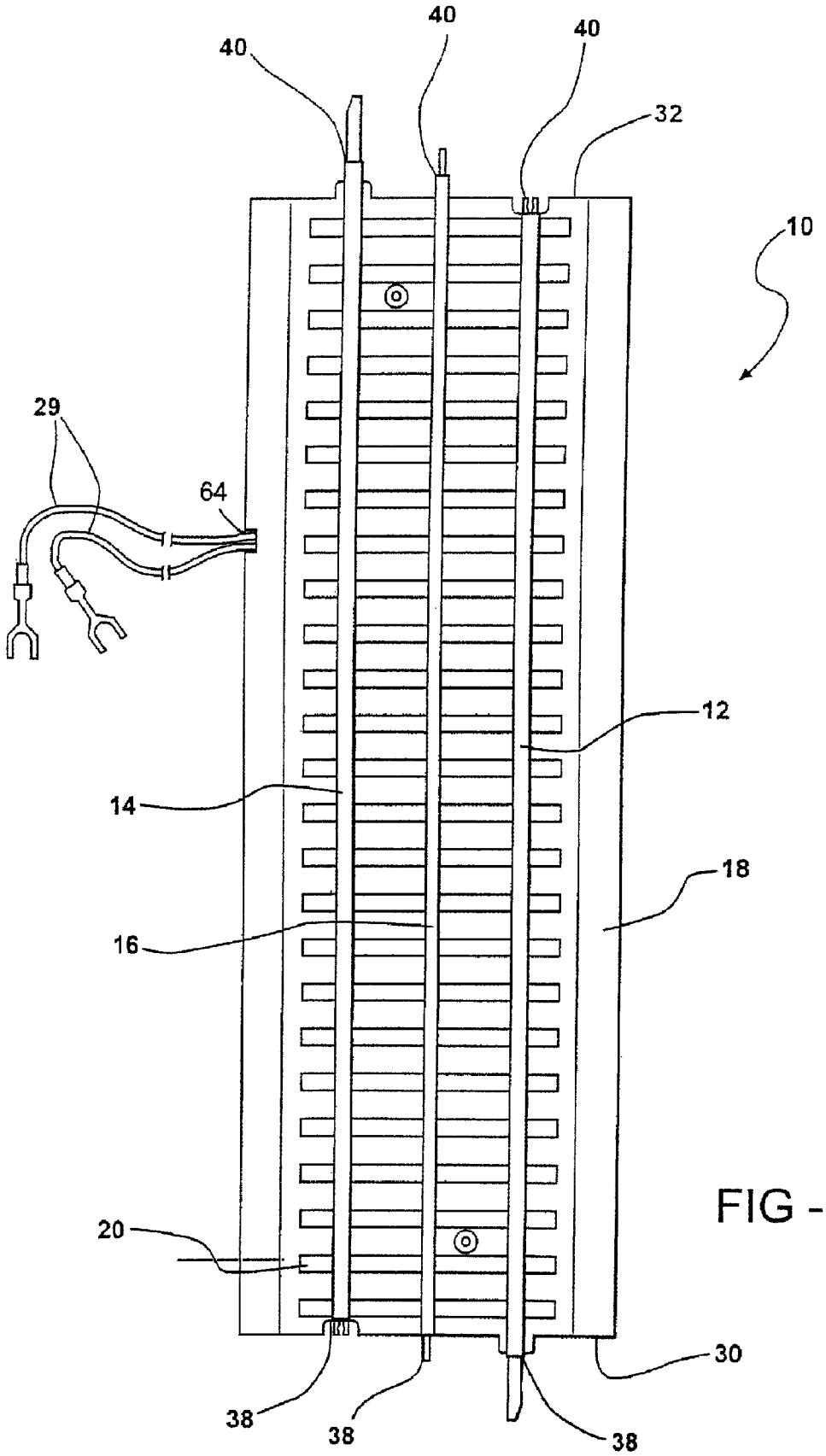
FIG. 1 is a plan top view of a railroad track segment.
Figure 2:
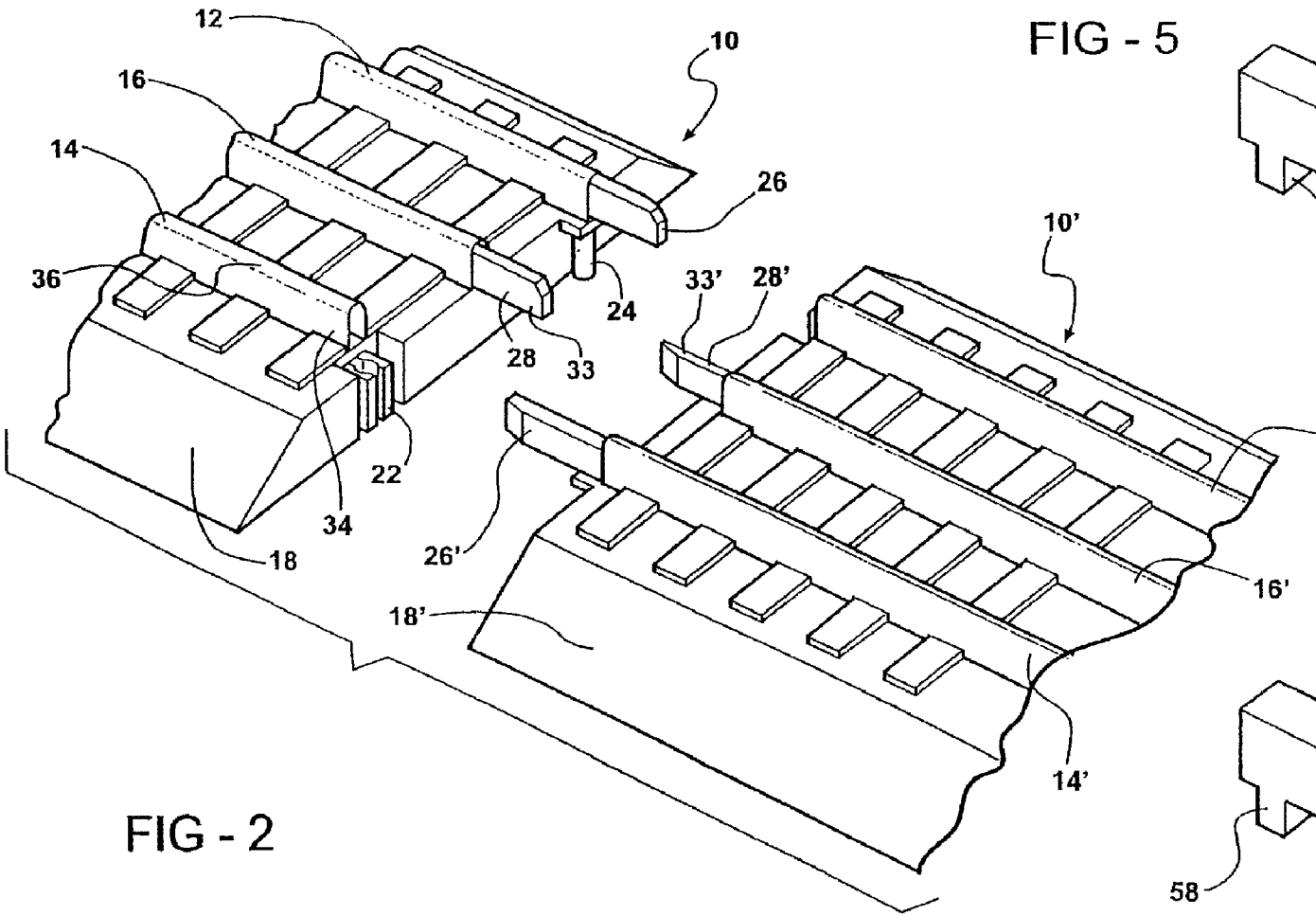
FIG. 2 is a perspective end view of two adjacent track segments.

With reference to the figures wherein like elements are numbered alike, there is shown a model toy train track with a roadbed according to the first preferred embodiment of the present invention. With reference to FIGS. 1 and 2, there is shown a track segment 10. Track segment 10 includes two outer rail segments 12, 14, one intermediate rail segment 16, and a roadbed 18. Rail segments 12, 14, 16 are mounted longitudinally on the roadbed 18 in a spaced apart manner such that the wheels (not shown) of the train can run along the outer rail segments 12,14 and a power roller or contact (not shown) can run along the intermediate rail segment 16. Rail segments 12, 14, 16 having first and second ends 38, 40, are positioned on top of the roadbed 18 and are preferably mechanically connected to the roadbed 18. The elongate intermediate rail segment 16 is interposed between the outer rail segments 12, 14. Each of the rail segments 12, 14, 16 have a substantially U-shaped hollow cross-section 34 with a substantially flat surface 36 (best shown in FIG. 2).

A pair of electrical lead wires 29 are shown ingressing through the aperture 64 located on the roadbed 18 for transporting electrical power from an electrical source (not shown) to the rails 12, 14, 16. Roadbed 18 may include a number of cosmetic features, for example, a plurality of ties 20 are positioned longitudinally along the top of each track segment 10. It is understood that these ties are preferably molded into the roadbed 18 to provide a more realistic looking railroad track.

FIG. 2 shows the ends of two track segments 10, 10' as each would appear prior to assembly with one another. Outer pins 26, 26' and intermediate pins 28, 28' are preferably preassembled in each track segment 10, 10' prior to connecting the track segments 10 and 10' together. The outer pins 26, 26' are used to mechanically and electrically connect the outer rail segments 12, 14 together with adjacent outer rail segments 12', 14' that have been assembled to an adjacent track segment 10'. Similarly, the intermediate pins 28, 28' are used to connect intermediate rail segment 16 with adjacent rail segment 16' for establishing a mechanical and an electrical link. The pins 26, 28 are preassembled and oriented with the rail segments 12, 14, 16 in a manner that allows any combination of straight and curved track segments to be assembled together without moving pins around to different locations.

The first outer pin 26 is engaged with the first end 38 of the first outer rail segment 12, and the second end 40 of the first outer rail 12 is adaptable for receiving an outer pin 26' that has been preassembled in an adjacent outer rail segment 12' on an adjacent track segment 10'. The second outer rail 14 has an outer pin 26 preassembled in the second end 40 thereof. The first end 38 of the second outer rail 14 is adaptable for receiving the outer pin 26' that has been preassembled in the adjacent rail segment 10'. The intermediate rail segment 16 has the intermediate pin 28 preassembled in both the first and second ends 38, 40 thereof. Each intermediate rail end 38, 40 is adaptable for receiving a second intermediate pin 28' that has been preassembled in an adjacent rail segment 16'. The second intermediate pins 28' are slidingly engageable with each preassembled intermediate pin 28 in rail segment 16.

Figure 3:
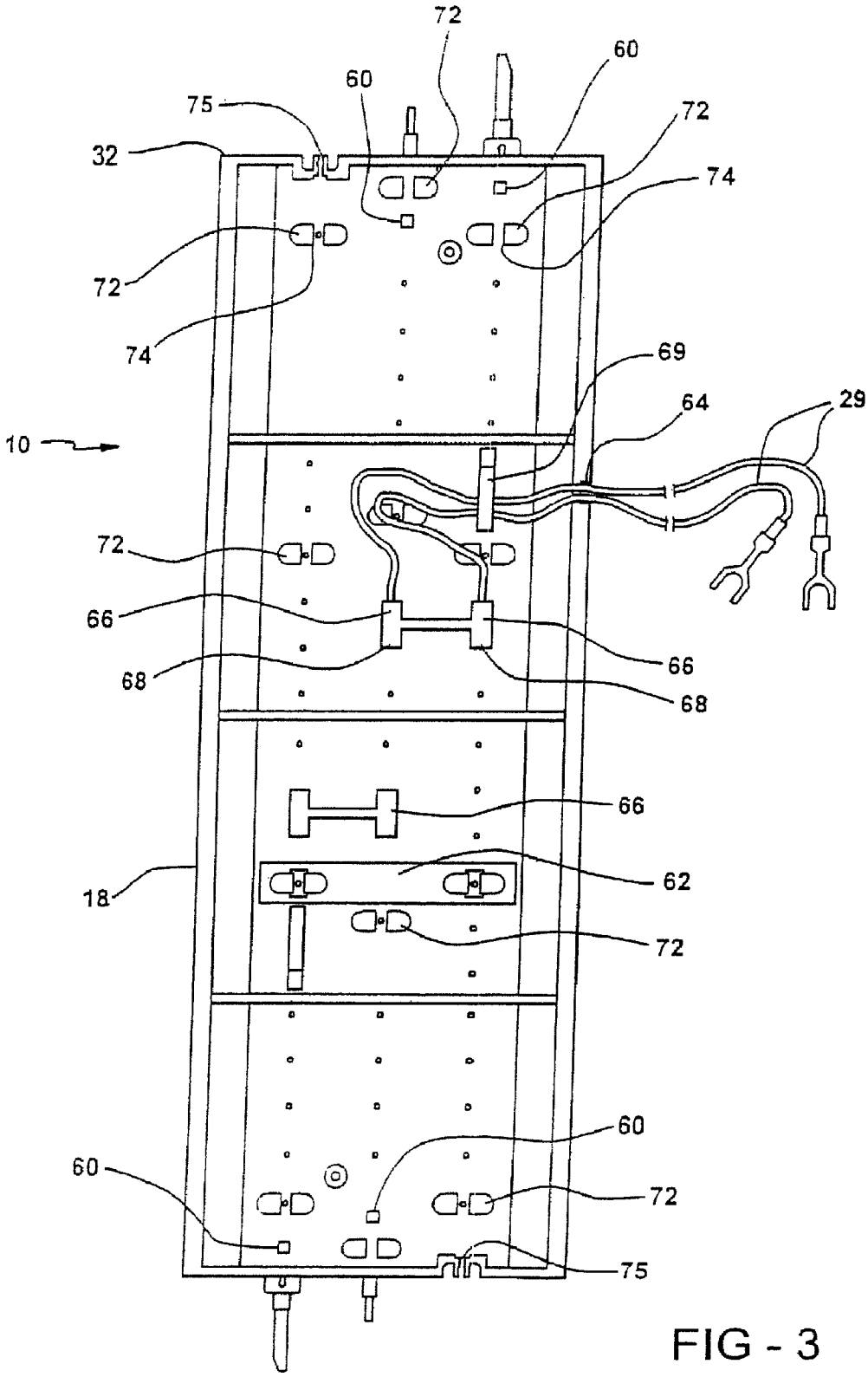
FIG. 3 is a plan underside view of the track segment.

FIG. 3 shows the underside of the roadbed 18. Electric power is delivered to the rails 12, 14 and 16 from the underside of the roadbed 18 with electrical contact wire leads 29. There is at least one aperture 64 located on the side of the roadbed 18 providing access from an electrical power source (not shown) to the track segment 10. A slot 66 is formed in the roadbed 18 to allow electrical communication between the rail segments 12, 14, 16 located on top of the roadbed 18 and the electrical wire leads 29 positioned on the underside of the roadbed 18. Each slot 66 is formed in conjunction with at least one pedestal 68 for holding the wire leads 29 in place on the underside of the roadbed 18. The pedestals 68 along with a second protruding member 69 protect the wire leads 29 from being pinched or inadvertently pulled from their connections to the rail segments 12, 14, 16.

Each rail segment 12, 14, 16 is fixedly held with respect to the roadbed 18 by sliding at least one pair of winged flanges 72, attached to each rail segment 12, 14, 16, through corresponding slots 74 in the roadbed 18. The winged flanges 72 are preferably metallic and are foldable normal to the direction of the slots 74 on the underside of the roadbed 18 to prevent the rail from disengaging from the roadbed 18. If winged flanges 72 are bent in such a way as to become parallel with the slots 74, the flanges will be capable of sliding back through the slots 74 to facilitate removal of the rail segments 12, 14, 16 from the roadbed 18.

A link 62 is positioned on the underside of roadbed 18 on each track segment 10 for electrically connecting each of the outer rail segments 12, 14 together to facilitate electrical communication and grounding between the outer rail segments 12, 14. The link 62, formed of an electrically conductive material, provides the constant ground loop portion of the electric circuit. The links 62 are connected with the winged flanges 72 of the outer rails 12, 14 and are positioned in a similar location on each track segment 10.

Figure 4:
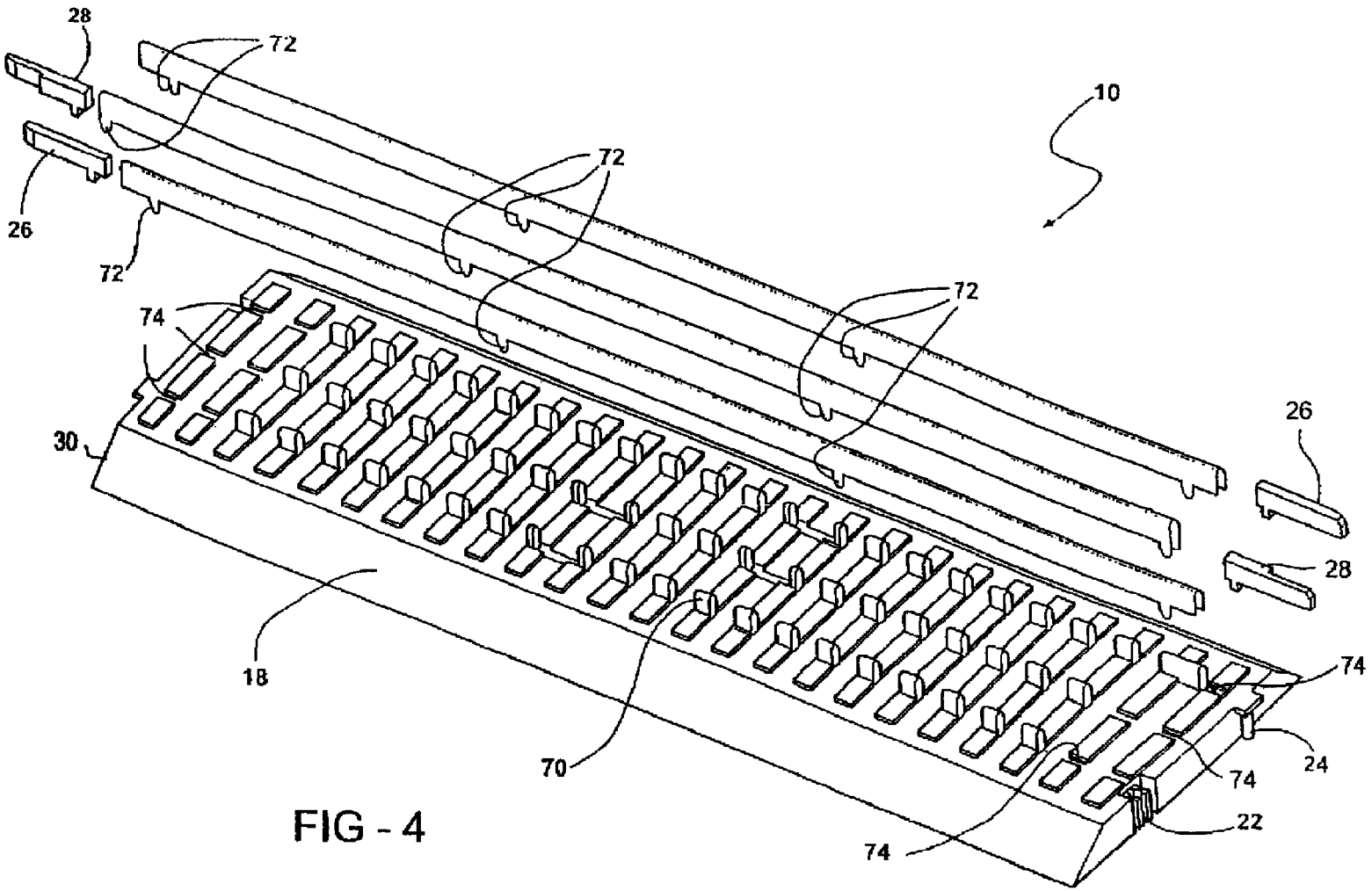
FIG. 4 is a perspective of an exploded view of the track segment.

Referring now to FIG. 4, an exploded view of the track segment 10 is shown with the rail segments 12, 14, 16 removed therefrom. Roadbed 18 is illustrated as including a plurality of ribs 70 extending substantially orthogonally from the top thereof in three rows corresponding to the three rail segments 12, 14, 16. The ribs 70 are shown as a plurality of discrete members in the drawing, but could be formed as one continuous member extending from one end 30 to the other end 32 of roadbed 18, and therefore, track segment 10. The ribs 70 are used to support the rail segments 12, 14, 16 from loads that may bend the thin metal rail walls. The ribs 70 may prevent the rail segments 12, 14, 16 from easily buckling and breaking. Also, in this view, the winged flanges 72 are shown integrally formed on the rail segments 12, 14, 16 prior to being slid through slots 74 and bent over onto the underside of the roadbed 18.

There is at least one snap fit connection on each track segment end 30, 32. The snap fit connection includes a male member 24 and a complementary female member 22 for snapping together and connecting adjacent track segments 10, 10'. The snap fit connectors 22, 24 are used for removably attaching adjacent track segments 10, 10' with respect to the interlocking portions of the complementary male 24 and female 22 members. The male member 24 is substantially cylindrical in shape and positioned on the end of the roadbed 18 for snap locking into the corresponding female member 22 on an adjacent roadbed segment 18. The female member 22 has a substantially internally reversed pattern relative to the male member 24. A slot 75 is formed through the front and back walls of the female member 22, so that increased deflection can be obtained, thus increasing the durability of the snap connection.

Figure 5:
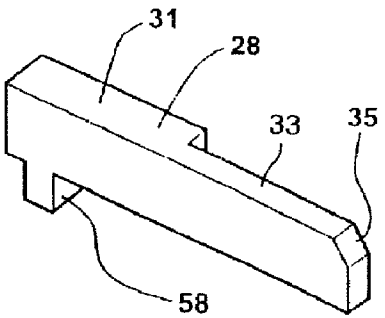
FIG. 5 is a perspective view of an intermediate pin.
Figure 6:
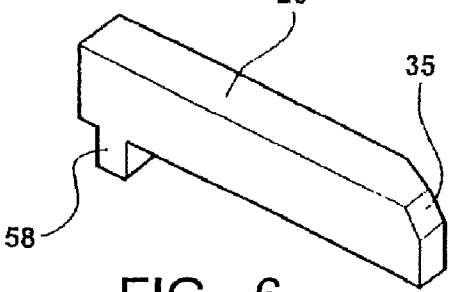
FIG. 6 is a perspective view of an outer pin.

FIGS. 5 and 6 show perspective views of the intermediate pin 28 and the outer pin 26. The pins may be cast from electrically conductive material, such as tin, copper, steel, zinc, etc. The intermediate pin 28 or "half pin" is substantially rectangular in shape having a width substantially the same as the width of the hollow cavity of the intermediate rail 16 along a first portion 31 of the intermediate pin 28. The width 31 of intermediate pin 28 narrows to substantially half of the width of the rail 16 along a second portion 33 of the intermediate pin 28.

Opposing intermediate pin ends 33, 33' as shown in FIG. 2, are positioned so as to be protruding away from opposing intermediate rail segments 16, 16' for slidingly engaging with one another as the track segments 10, 10' are assembled together. The outer pins 26 are substantially rectangular in shape and have substantially constant width throughout the entire length of the outer pin 26. Both the outer pins 26 and the intermediate pins 28 have selectively placed chamfers 35 on the edges thereof for facilitating their slidingly engageable characteristics with respect to an adjacent rail segment 10'. Each of the outer 26 and intermediate 28 pins has a peg 58 protruding substantially orthogonally therefrom. The peg 58 is insertable into an aperture 60 located in the roadbed 18 as shown in FIG. 3. The peg 58 and the aperture are shown with a substantially square cross-section, however, any geometric shape, such as circular, triangular, or rectangular, could be utilized. The aperture 60 for the peg 58 prevents the pins 26, 28 from moving relative to the roadbed 18 in a lateral or longitudinal direction with respect to the roadbed 18. After the rails 12, 14, 16 are assembled and locked into position over the pins 26, 28, the pins 26, 28 are then prevented from moving away from the roadbed 18 in an orthogonal direction as well as in the lateral and longitudinal directions.

As referenced in general above, it is understood that a plurality of track segments 10 may be connected together end to end in various manners to provide a completed track (not shown) for the toy train to run continuously thereon. Referring to FIG. 2, track segment 10 may be assembled with similar track segments 10' in a longitudinally adjacent relationship and mechanically connected with snap fit connections 22, 24. Rail segments 12, 14, 16 are connected to adjoining rail segments 12', 14', 16' on the adjacent track segments 10' with outer pins 26, 26' and an intermediate pin 28, 28' for the outer rails 12, 14 and intermediate rail 16, respectively. The track is not limited to any particular configuration, but may be constructed in any manner according to the operator's desire.

Figure 7:
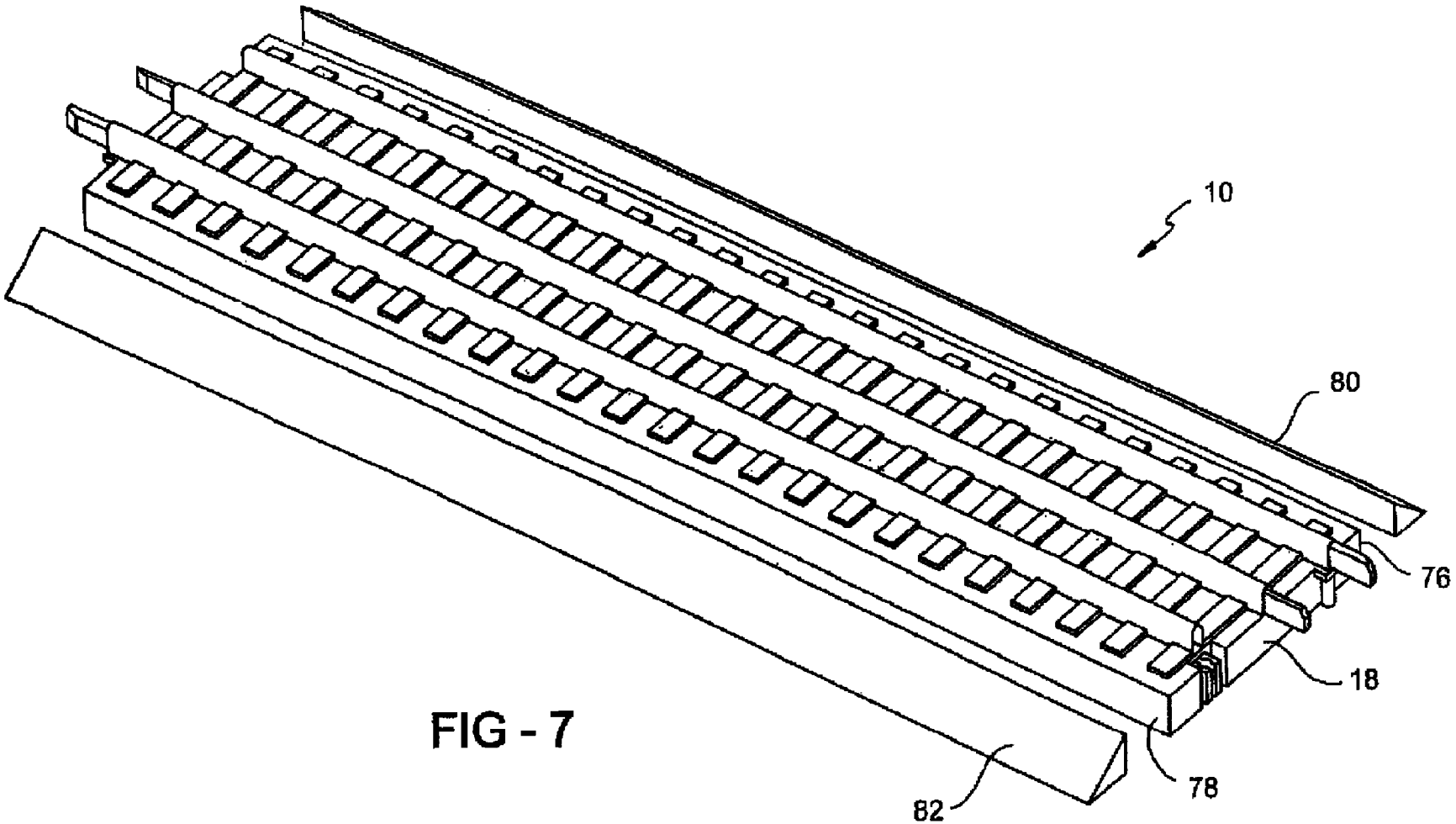
FIG. 7 is a perspective view of an exemplary track segment having at least one detachable side member.
Figure 8:
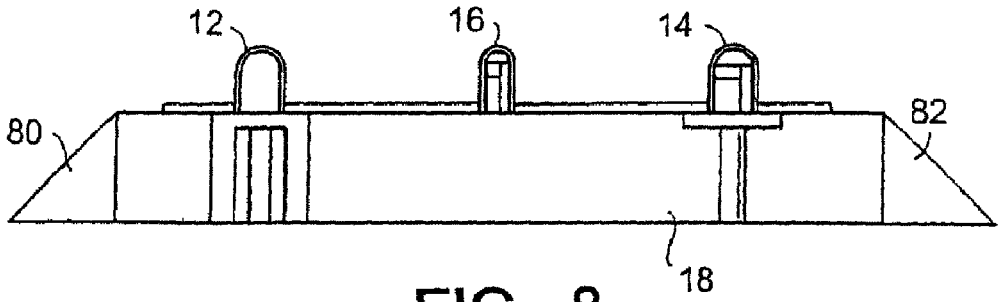
FIG. 8 is an end elevation view of the track segment of FIG. 7.

FIGS. 7 and 8 show an additional feature of track segment 10, and roadbed 18 in particular. In an exemplary embodiment, roadbed 18 includes first and second sides 76, 78. In one exemplary embodiment, at least one of sides 76, 78 is configured to have a detachable side member 80 coupled thereto. In another exemplary embodiment, each of sides 76, 78 are configured to have respective first and second side members 80, 82 coupled thereto, with one or both of side members 80, 82 being detachably coupled to sides 76, 78, and therefore, roadbed 18. In either embodiment, side members 80, 82 are configured to be both detachable and reattachable to sides 76, 78. Additionally, side members 80, 82 may comprise one contiguous piece spanning the length of track segment 10 or a lesser portion thereof, or may be comprised of separate pieces configured to be individually detached and reattached to roadbed 18 and that have the appearance of one piece when all of the separate pieces are attached to roadbed 18. Roadbeds having detachable sides provide a number of advantages, such as, for example, increased adaptability and versatility of track segment 10 in track layouts wherein space constraints limit the width of the track to be used in the layout. Additionally, because side members 80, 82 can be reattached to roadbed 18, the structure and use of track segment 10 is not permanently altered or limited. Side members 80, 82 can be detachably coupled to sides 76, 78 of roadbed 18 by any number of coupling arrangements, such as, for example purposes only, screws, snaps, slot arrangements, and lap connections.

Figure 9:
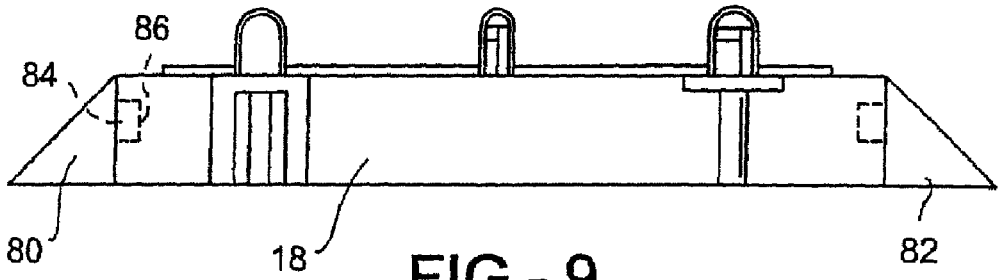
FIG. 9 is an end elevation view of an exemplary embodiment of the track segment of FIGS. 7 and 8.
Figure 10A:
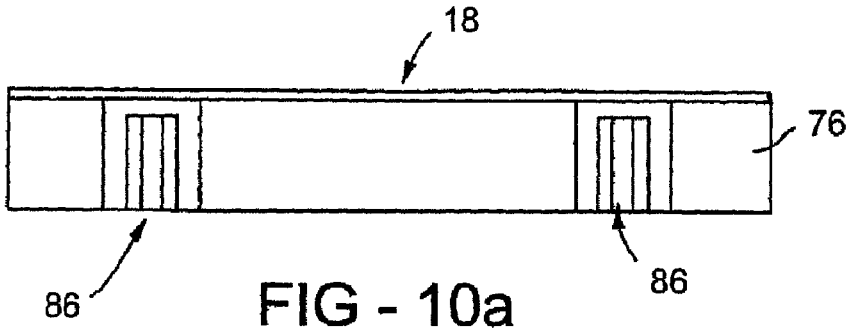
FIGS. 10*a*-10*b* are side elevation views of the track segment and side members of FIG. 9.
Figure 10B:
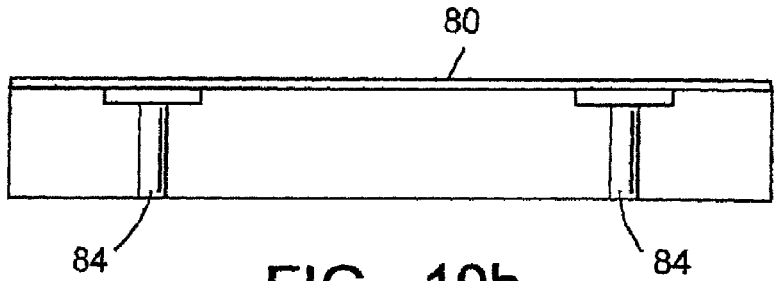

With reference to FIGS. 9-10*b*, in an exemplary embodiment wherein both side members 80, 82 are detachably coupled to roadbed 18, side members 80, 82 are coupled to respective sides 76, 78 by way of a snap fit connector. In this configuration, each of side members 80, 82 can be detached and interchangeably reattached to track sides 76, 78. In one embodiment, each of side members 80, 82 include one or more male members 84, while each of sides 76, 78 of roadbed 18 include one or more complementary female members 86 configured to receive male members 84 for snapping side members 80, 82 and roadbed 18 together. In this exemplary arrangement, male member 84 is substantially cylindrical in shape and is configured for snap locking into corresponding female member 86. Female member 86 substantially includes an internally reverse pattern relative to male member 84, and a slot formed through a front and a back wall configured for receiving male member 84. This configuration may be the same as shown in perspective view in FIG. 4 (male member 24 and female member 22). This coupling arrangement provides for increased deflection, thereby increasing the durability of the snap fit connector. It should be noted that the same arrangement and functionality could be achieved if only one of side members 80, 82 was detachably coupled to roadbed 18, or if side members 80, 82 include female member 86, while sides 76, 78 of roadbed 18 include male member 84. Accordingly, these arrangements remain within the spirit and scope of the present invention.

Figure 11:
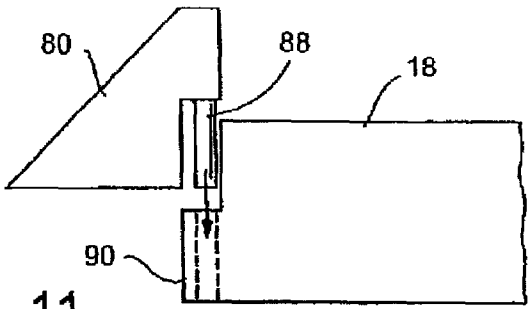
FIG. 11 is a partial side elevation view of an alternate embodiment of the track segment of FIG. 7.

With reference to FIG. 11, in an alternate embodiment, one or each of side members 80, 82 include one or more posts or tabs 88 extending therefrom, and one or each of roadbed sides 76, 78 include one or more corresponding recesses or slots 90 configured for receiving tab 88. Side members 80, 82 may include a number of tabs 88 spaced a predetermined distance apart from each other along the length of the side members, or may include a single tab 88 spanning the entire length of side members 80, 82. Similarly, slot 90 may be a number of slots corresponding to the number of tabs 88, or may be a continuous slot extending from end 30 of each of sides 76, 78 of roadbed 18 to the end 32 of roadbed 18, such that roadbed 18 and sides 76, 78 in particular, may receive side members having a single tab 88 or more than one of tabs 88.

It should be noted that while only those embodiments set forth above are discussed in detail, they are provided for exemplary purposes only and are not limiting in nature. Those skilled in the art will recognize that other coupling configurations/arrangements exist that remain within the spirit and scope of this invention.

Figure 12:
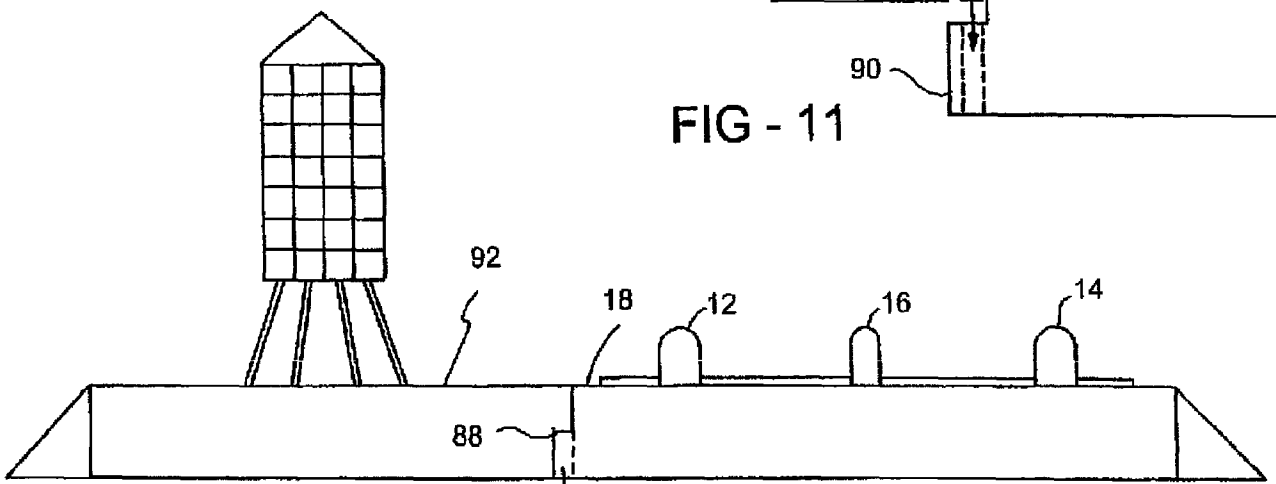
FIG. 12 is an end elevation view of the track segment of FIG. 7 having an accessory coupled thereto.

With reference to FIG. 12, in an exemplary embodiment, track segment 10 is further configured to receive a track side accessory 92 when either one or both of side members 80, 82, or portions thereof, are detached from roadbed 18. Accessory 92 may be either an operating accessory requiring electrical power to operate, such as, for example, a camp fire scene that plays music, a functioning coal filling station, a house with operating lights, etc.; a non-electric mechanically operating feature; or a non-operating accessory, such as, for example, landscapes, waterscapes, non-operating buildings, etc. As with side members 80, 82, accessory 92 can be detachably and reattachably coupled to roadbed 18 in any number of coupling arrangements, such as, for example, screws, snaps, slot arrangements, or lap connections. Additionally, accessory 92 can be coupled to roadbed 18 at virtually any point along track segment 10 when one or both of side members 80, 82 are removed. In one embodiment, portions of side members 80, 82 can be removed to allow for the coupling of accessory 92 to roadbed 18 without having to remove the entire side of the track segment.

Figure 13:
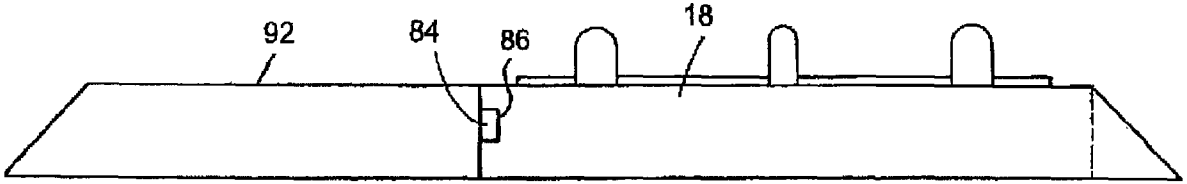
FIG. 13 is an end elevation view of an exemplary embodiment of the track segment and accessory of FIG. 12.

With reference to FIGS. 10*a*-10*b* and 13, in an exemplary embodiment, accessory 92 is configured to be coupled to track segment 10, and roadbed 18 in particular, by way of a snap fit connector. In this arrangement, as with side members 80, 82 discussed above, accessory 92 includes at least one male member 84, while at least one of sides 76, 78 of roadbed 18 include at least one complementary female member 86 configured to receive male member 84. In this exemplary arrangement, male member 84 is substantially cylindrical in shape and is configured for snap locking into corresponding female member 86. Female member 86 substantially includes an internally reverse pattern relative to male member 84, and a slot formed through a front and a back wall configured for receiving male member 84. This configuration provides for increased deflection, thereby increasing the durability of the snap fit connector. When accessory 92 is coupled to track segment 10 in this arrangement, to top surface of accessory 92 is substantially flush with the top surface of roadbed 18 and thereby creates a smooth transition between the top surface of roadbed 18 and the top surface of accessory 92. It should be noted that the same functionality can be achieved in an alternate embodiment wherein accessory 92 includes female member 86 and sides 76, 78 include male member 84. Accordingly, this arrangement remains within the spirit and scope of the present invention.

With reference to FIGS. 11 and 12, in another exemplary embodiment, accessory 92 includes one or more posts or tabs 88 extending therefrom, and at least one of sides 76, 78 of roadbed 18 include one or more corresponding recesses or slots 90 configured for receiving tab 88. Accessory 92 may include a number of tabs 88 or may include a single tab 88 spanning the entire length of accessory 92. Similarly, slot 90 may be a number of slots corresponding to the number of tabs 88, or may be a continuous slot 90 extending from end 30 of roadbed 18 to the end 32 of roadbed 18, such that roadbed 18 may receive accessories having a single tab 88 or more than one of tabs 88. As with the coupling arrangement discussed above, when accessory 92 is coupled to track segment 10 in this arrangement, to top surface of accessory 92 is substantially flush with the top surface of roadbed 18 and thereby creates a smooth transition between the top surface of roadbed 18 and the top surface of accessory 92. The arrangement and configuration discussed above and to be further discussed below provides advantages over conventional arrangements wherein the detailing and accessorizing of a layout include more permanent and limited placement of accessories. Conversely, the arrangement described herein can be used on all types of surfaces without the need for gluing or other methods of permanently affixing accessories. Accordingly, layouts can now be assembled easily and quickly, and the accessories can be interchanged with little trouble.

It should be noted that the above-described arrangements are provided for exemplary purposes only and are not meant to be limiting in nature. Any number of coupling arrangements exist that will carry out the same functionality and, therefore, remain within the spirit and scope of the present invention.

Figure 14:
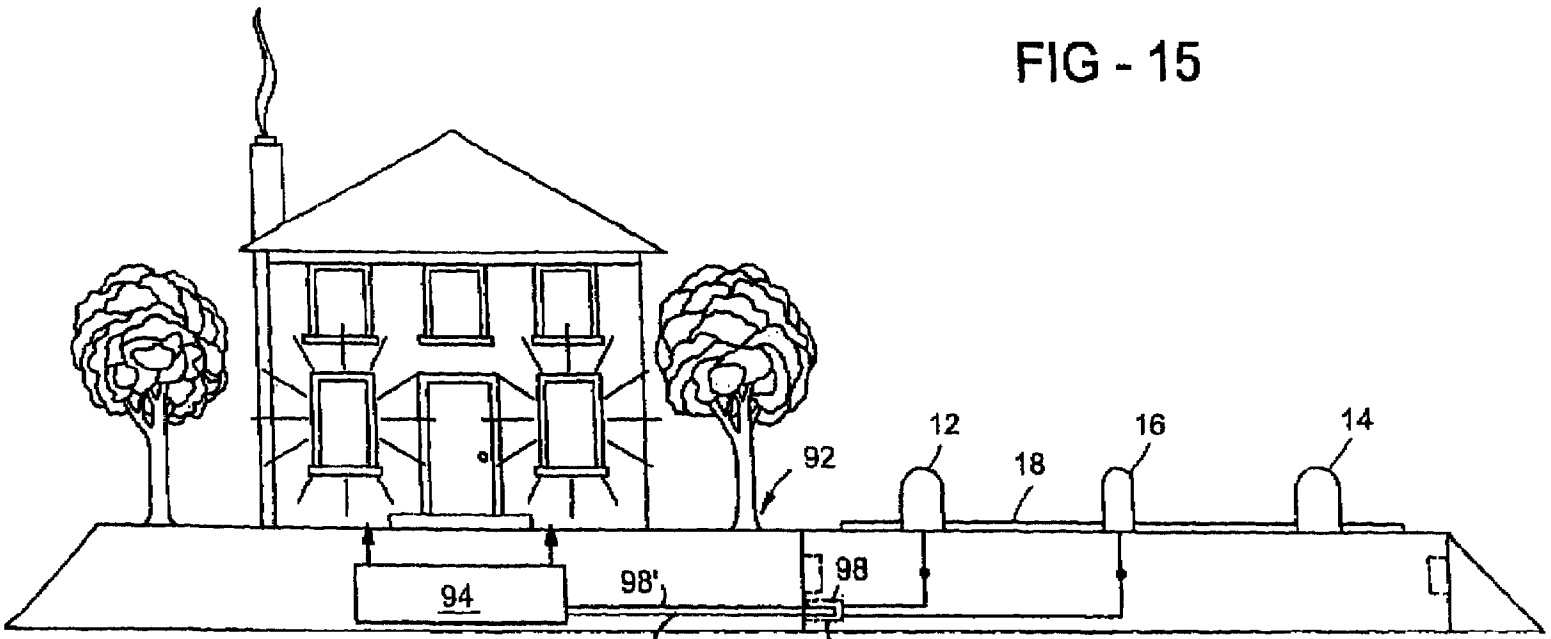
FIG. 14 is an end elevation view of an exemplary embodiment of the track segment and accessory of FIG. 12 wherein the track segment and accessory are electrically and mechanically coupled together.

However, accessory 92 may non-operating decorative scenes or mechanically operating accessories wherein the user controls the operation of the accessory by way of mechanical switches and the like. With reference to FIG. 14, accessory 92 may also include components or features that require electric power or other electrical signals to operate. For example, accessory 92 may have an audio feature configured to play songs or other sounds, a lighting feature, and/or a moveable feature driven by a motor. Accordingly, accessory 92 having some or all of these features includes an electrical circuit 94, which, in an exemplary embodiment, may include a conventional sound amplifier and/or a controller configured to receive inputs and generate outputs that that is operative to control the operation of a motor and the operation of the features of accessory 92. In this arrangement, track segment 10 and accessory 92 are configured such that electrical circuit 94 of accessory 92 can be electrically connected to the electrical system of track segment 10 (i.e., rail segments 12, 14, 16). Accordingly, the features of accessory 92 can be activated in a number of ways, such as, for example purposes only, by the application of power to rail segments 12, 14, 16, and therefore, circuit 94; by a user command applied to the tracks (i.e., DC offsets or digital commands); or by a remote control signal received by the circuit 94 itself. In still another embodiment, accessory 92 can be wired apart from the track system so that operating power and control is provided from an external source and device and independently from track segment 10. In this embodiment, accessory 92 can be, for example, plugged into a wall outlet or connected to output terminals of a transformer, and a conventional control switch can be used to actuate the accessory.

With continued reference to FIG. 14, in one exemplary embodiment, a positive electrical contact 96 is connected to power rail segment 16 and a neutral electrical contact 98 is connected to one of electrically neutral rail segments 12, 14. Similarly, electrical circuit 94 of accessory 92 includes a positive electrical contact 96' and a neutral electrical contact 98'. The electrical contacts are configured such that when accessory 92 is coupled to roadbed 18, positive contact 96 of track segment 10 makes contact with positive contact 96' of accessory 92, while neutral contact 98 of track segment 10 makes contact with neutral contact 98' of accessory 92, so as to complete an electrical circuit for accessory 92, thereby supplying circuit 94 with operating power. In one embodiment, contacts 96, 98 are electrically connected to the electrical system of track segment 10 (i.e., rail segments 12, 14, and 16) by way of leads, such as, for example, link 62 (not shown), positioned on the underside of roadbed 18. Similarly, contacts 96', 98' are electrically connected to circuit 94 by way of leads, such as, for example, link 62 (not shown) positioned on the underside of accessory 92. In an exemplary embodiment shown in FIG. 14, the electrical contacts comprise a "plug" arrangement wherein contacts 96, 98, for example, are configured to be the female socket and are positioned in sides 76, 78 of roadbed 18, while contacts 96', 98', for example, are configured to be the male element and are positioned at an outer edge of accessory 92, or vice versa. Accordingly, when accessory 92 and roadbed 18 are coupled together, the male element of accessory 92 is "pluged" into the female socket on roadbed 18 and electrical power is provided to accessory 92 without having to add any extra wiring connections, and therefore, without requiring the user to connect any wires. Accordingly, a "plug and play" arrangement is created between the accessory and the roadbed.

Figure 15:
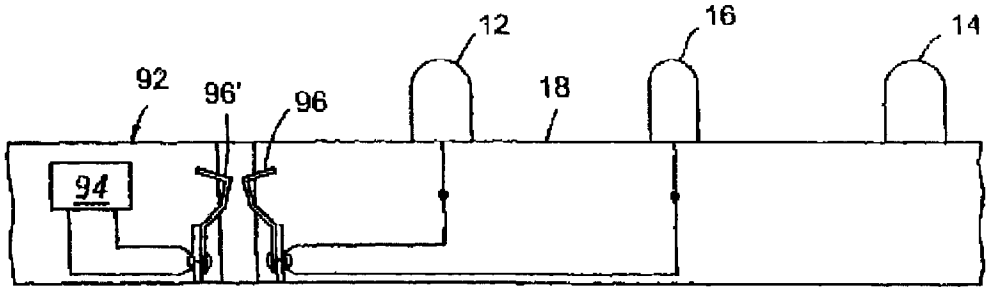
FIG. 15 is a partial end elevation view of an alternate embodiment of the track segment and accessory of FIG. 12 wherein the track segment and accessory are electrically and mechanically coupled together.

With reference to FIG. 15, another exemplary embodiment is shown. In this embodiment, contacts 96, 98 (only contacts 96 and 96' are shown) are in the form of compressible contacts positioned on sides 76,78, while electrical contacts 96', 98' are compressible contacts positioned on accessory 92. The respective contacts are configured such that when accessory 92 and roadbed 18 are brought into contact, electrical contacts 96, 96', 98, 98' make respective contact with each other, and compress in such away that an electrical connection is made and maintained between the contacts 96, 96' and 98, 98' until accessory 92 and roadbed 18 are separated. It should be noted that in this embodiment and configuration, the exemplary coupling arrangements used to couple accessory 92 to roadbed 18 and described in greater detail above provide a lock/release functionality such that the compressible contacts will not cause accessory 92 and roadbed 18 to push away from each other, and thereby separate, when the contacts are compressed. Rather, the coupling arrangement used serves to lock accessory 92 and roadbed 18 together until separated by the user. As with the embodiment discussed above, in this embodiment no additional electrical connections are required and the user need not have to connect any extra wires.

In still another exemplary embodiment, male member 84 and female member 86 or tabs 88 and slots 90, depending on the coupling arrangement, include electrical contacts 96, 96', 98, 98' integral therewith, which are electrically connected to electrical circuit 94 and the power system of track segment 10, respectively. Accordingly, when accessory 92 is mechanically coupled to roadbed 18, the respective electrical contacts make contact with each other and complete the electrical circuit between the power system of track segment 10 and accessory 92, thereby supplying operating power to accessory circuit 94.

It should be noted, however, that these electrical connecting arrangements are provided for exemplary purposes only and are not meant to be limiting in nature. Any number of connecting means can be used to carry out the above-stated functionality, and therefore, remain within the spirit and scope of the present invention. Accordingly, in an arrangement wherein accessory 92 has an electrical circuit 94 to drive various components thereof and is coupled to roadbed 18, power is provided to circuit 94 by way of the power supplied to rails 12, 14, 16, thereby allowing for the operation of the features of accessory 92, such as, for example, the illumination of lights or the playing of sound.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A track segment for a model toy train comprising:

a roadbed having first and second ends;

first and second outer rail segments connected to the roadbed, each outer rail segment having a hollow cross section, a first end proximate the first roadbed end, and a second end proximate the second roadbed end;

an intermediate rail segment interposed between the first and second outer rail segments and connected to the roadbed, the intermediate rail segment having a hollow cross section, a first end proximate the first roadbed end, and a second end proximate the second roadbed end;

a first outer pin engaged with the first end of the first outer rail, the second end of the first outer rail being adapted to receive an outer pin preassembled in an adjacent outer rail segment positioned on a first adjacent track segment;

a second outer pin engaged with the second end of the second outer rail, the first end of the second outer rail being adapted to receive an outer pin preassembled in an adjacent outer rail segment positioned on a second adjacent track segment;

an intermediate pin engaged with the second end of the intermediate rail, the first end of the intermediate rail being adapted to receive an intermediate pin preassembled in an adjacent intermediate rail segment positioned on the second adjacent track segment; and a first connector on the first roadbed end, the first connector having a male element and being adapted for connection with a second connector on the second adjacent track segment, the second connector having a female element that is complementary to the male element of the first connector;

wherein the first outer pin extends past the first connector on the first roadbed end, thereby allowing the first end of the second outer rail to receive the outer pin preassembled in the adjacent outer rail segment on the second adjacent track segment prior to the second connector on the second adjacent track segment receiving the first connector on the first roadbed end.

2. The track of claim 1, further comprising a third connector on the first roadbed end, the third connector having a female element and being adapted for connection with a fourth connector on the second adjacent track segment, the fourth connector having a male element that is complementary to the female element of the third connector, wherein the outer pin preassembled in the adjacent outer rail segment on the second adjacent track segment extends past the fourth connector on the second adjacent track segment, thereby allowing the first end of the second outer rail to receive the outer pin preassembled in the adjacent outer rail segment on the second adjacent track segment prior to the third connector on the first roadbed end receiving the fourth connector on the second adjacent track segment.

3. The track of claim 2, wherein the first and third connectors are substantially aligned with the first and second outer rail segments.

4. The track of claim 1, further comprising a second intermediate pin engaged with the first end of the intermediate rail, the second end of the intermediate rail being adapted to receive an intermediate pin preassembled in an adjacent intermediate rail segment positioned on the first adjacent track segment.

5. The track of claim 1, wherein the outer and intermediate pins are cast from an electrically conductive material.

6. The track of claim 1, further comprising a link positioned on an underside of the roadbed and attached to at least one of the first and second outer rail segments for communicating electrical ground between the at least one of the first and second outer rail segments on the track segment, the first adjacent track segment and the second adjacent track segment, the link forming a constant ground loop portion of an electric circuit.

7. The track of claim 1, further comprising at least one slot formed through the roadbed such that electrical communication with at least one of the first outer rail segment, the second outer rail segment and the intermediate rail segment can be implemented with an electrical wire lead from an underside of the roadbed.

8. The track of claim 1, wherein the first outer rail segment, the second outer rail segment and the intermediate rail segment includes a substantially flat top.

9. The track of claim 1, wherein the first outer rail segment, the second outer rail segment and the intermediate rail segment includes a substantially U-shaped, hollow cross section.

10. A track segment for a model toy train comprising:

a roadbed having first and second ends, wherein the first roadbed end includes (1) a first male element that is complementary to a second female element in a second adjacent track segment and (2) a first female element that is complementary to a second male element in the second adjacent track segment, the first and second male and female elements being used to connect the track segment to the second adjacent track segment;

first and second outer rail segments connected to the roadbed, each outer rail segment having a hollow cross section with a substantially flat top surface, a first end proximate the first roadbed end, and a second end proximate the second roadbed end;

an intermediate rail segment interposed between the first and second outer rail segments and connected to the roadbed, the intermediate rail segment having a hollow cross section with a substantially flat top surface, a first end proximate the first roadbed end, and a second end proximate the second roadbed end;

a first outer pin engaged with the first end of the first outer rail, the second end of the first outer rail being adapted to receive an outer pin preassembled in an adjacent outer rail segment positioned on a first adjacent track segment;

a second outer pin engaged with the second end of the second outer rail, the first end of the second outer rail being adapted to receive an outer pin preassembled in an adjacent outer rail segment positioned on the second adjacent track segment; and an intermediate pin engaged with the second end of the intermediate rail, the first end of the intermediate rail being adapted to receive an intermediate pin preassembled in an adjacent intermediate rail segment positioned on the second adjacent track segment;

wherein the first outer pin extends past the first male element, thereby allowing the first end of the second outer rail to receive the outer pin preassembled in the adjacent outer rail segment positioned on the second adjacent track segment prior to the second female element receiving the first male element, and prior to the first female element receiving the second male element.

11. The track of claim 10, wherein the second roadbed end includes (1) a third male element that is complementary to a fourth female element in the first adjacent track segment and (2) a third female element that is complementary to a fourth male element in the first adjacent track segment, the third and fourth male and female elements being used to connect the track segment to the first adjacent track segment.

12. The track of claim 10, wherein the first female and male elements are substantially aligned with the first and second outer rail segments.

13. The track of claim 10, further comprising a link positioned on an underside of the roadbed and attached to the first and second outer rail segments for communicating electrical ground between the first and second outer rail segments on the track segment and the first and second adjacent track segment, the link forming a constant ground loop portion of an electric circuit.

14. The track of claim 10, further comprising at least one aperture located on a side of the roadbed for allowing access to an electrical power source.

15. The track of claim 10, further comprising at least one slot formed through the roadbed such that electrical communication with at least one of the first outer rail segment, the second outer rail segment and the intermediate rail segment can be implemented with an electrical wire lead from an underside of the roadbed.

16. The track of claim 10, further comprising at least one pedestal for holding wire leads in place on an underside of the roadbed.

17. The track of claim 10, wherein the intermediate rail segment includes a substantially U-shaped, hollow cross section.

18. A track segment for a model toy train comprising:

a roadbed having first and second ends, wherein (1) the first roadbed end includes a first male element that is complementary to a second female element in a second adjacent track segment and a first female element that is complementary to a second male element in the second adjacent track segment, (2) the second roadbed end includes a third male element that is complementary to a fourth female element in a first adjacent track segment and a third female element that is complementary to a fourth male element in the first adjacent track segment, (3) the first and second male and female elements are used to connect the track segment to the second adjacent track segment, and (4) the third and fourth male and female elements are used to connect the track segment to the first adjacent track segment;

first and second outer rail segments connected to the roadbed, each outer rail segment having a hollow cross section with a substantially flat top surface, a first end proximate the first roadbed end, and a second end proximate the second roadbed end;

an intermediate rail segment interposed between the first and second outer rail segments and connected to the roadbed, the intermediate rail segment having a hollow cross section with a substantially flat top surface, a first end proximate the first roadbed end, and a second end proximate the second roadbed end;

a first outer pin engaged with the first end of the first outer rail, the second end of the first outer rail being adapted to receive an outer pin preassembled in an adjacent outer rail segment positioned on a first adjacent track segment;

a second outer pin engaged with the second end of the second outer rail, the first end of the second outer rail being adapted to receive an outer pin preassembled in an adjacent outer rail segment positioned on a second adjacent track segment;

an intermediate pin engaged with the second end of the intermediate rail, the first end of the intermediate rail being adapted to receive an intermediate pin preassembled in an adjacent intermediate rail segment positioned on the second adjacent track segment;

wherein the first outer pin extends past the first male element, thereby allowing the first end of the second outer rail to receive the outer pin preassembled in the adjacent outer rail segment positioned on the second adjacent track segment prior to the second female element receiving the first male element, and prior to the first female element receiving the second male element.

19. The track of claim 18, further comprising a second intermediate pin engaged with the first end of the intermediate rail, the second end of the intermediate rail being adapted to receive an intermediate pin preassembled in an adjacent intermediate rail segment positioned on the first adjacent track segment.

20. The track of claim 18, wherein the first and third male and female elements are substantially aligned with the first and second outer rail segments.

* * * * *